United States Patent [19]

Feaster

[11] 4,444,725

[45] Apr. 24, 1984

[54] CATALYTIC BOOSTER DEVICE FOR VEHICULAR EXHAUST SYSTEMS AND METHOD OF INSTALLING

[76] Inventor: Donavon L. Feaster, 9 Oliver's La., Mattapoisett, Mass. 02739

[21] Appl. No.: 396,432

[22] Filed: Jul. 8, 1982

[51] Int. Cl.[3] ..... F01N 3/10

[52] U.S. Cl. ..... 422/180; 55/491; 55/DIG. 30; 60/299; 60/308; 422/177

[58] Field of Search ..... 422/177, 180; 60/298, 60/308; 417/168; 55/491, 510, 497–499, DIG. 30

[56] References Cited

U.S. PATENT DOCUMENTS

| | | | |
|---|---|---|---|
| 3,022,934 | 2/1962 | Gerald | 417/168 |
| 3,043,097 | 7/1962 | Inman et al. | 417/168 |
| 3,050,376 | 8/1962 | Bishop et al. | 60/308 X |
| 3,944,505 | 3/1976 | La Croix | 422/177 X |
| 4,032,310 | 6/1977 | Ignoffo | 422/177 X |
| 4,078,898 | 3/1978 | Fedor et al. | 422/177 |
| 4,220,625 | 9/1980 | Toh et al. | 422/180 |
| 4,250,146 | 2/1981 | Bailey | 422/180 X |

*Primary Examiner*—Richard L. Chiesa
*Attorney, Agent, or Firm*—George A. Gust

[57] ABSTRACT

A catalytic booster-converter for insertion into the exhaust pipe of a vehicular exhaust system comprising an elongated conduit device adapted to be rigidly connected in series with an exhaust pipe intermediate the ends thereof. The elongated conduit device is in separate length portions which are spaced apart a predetermined distance. A catalytic converter element is interposed between and removably secured to the facing ends of said length portions. A converter element is secured between such length portions in such a manner that it can be removed and replaced by movement transversely of the conduit device.

1 Claim, 7 Drawing Figures

CATALYTIC BOOSTER DEVICE FOR VEHICULAR EXHAUST SYSTEMS AND METHOD OF INSTALLING

BACKGROUND OF THE INVENTION

1. Field of the Invention

The present invention relates to vehicular exhaust systems and more particularly to catalytic devices for use in such systems.

2. Description of the Prior Art

It is conventional to use catalytic converters for reducing the pollution of the atmosphere due to the operation of internal combustion engines. Theoretically, vehicular emissions are considered to contribute to atmospheric pollution, hydrocarbons and other organic compounds discharged into the atmosphere tending to react and form compounds that reduce visibility and irritate the eyes and nose. The automotive industry has researched the technique of catalytic oxidation of exhaust fumes as a possible partial solution to the pollution problem. Many different apparatuses and methods have been employed for the purpose of reducing the polluting effect of vehicular exhaust emissions, typical of these being disclosed in U.S. Pat. Nos. 3,022,934; 3,050,376; 3,598,540; 3,741,730; 4,094,645 and 4,209,493.

The more popular catalytic converters are relatively expensive and constitute more or less permanent components in vehicular exhaust systems. Such components, after a period of usage, tend to lose effectiveness and must be replaced. Such replacement constitutes a material item of expense and generally is a procedure requiring the services of a mechanic. As a consequence, it is presumed that a large number of vehicles are being operated with converters that are ineffective thereby tending to defeat in the first instance the use of converters.

SUMMARY OF THE INVENTION

The present invention relates to a relatively simple method of installing a catalytic booster-type converter in the vehicular exhaust system as well as a booster apparatus per se. The method of installing such a booster-type converter in the vehicular exhaust system having a length of exhaust pipe includes the steps of fitting a section of conduit to the exhaust pipe in such a manner as to be a continuation thereof. The conduit section is formed into two separate lengths of conduit, and a catalytic converter element is removably secured between and to such separate conduit lengths whereby gases flowing through the exhaust pipe also flow through the converter element. The method may further include the steps of removing a length section from the exhaust pipe intermediate the ends thereof and then fitting the section of conduit to the exhaust pipe in place of the removed section. Securing of the catalytic element into the section of conduit includes the feature of replacing the catalytic element by moving it laterally from its position and replacing it with a new catalytic element by also moving it laterally into position and then securing the element in place.

The catalytic booster-type converter of this invention is designed to be inserted into the length of the exhaust pipe of a vehicle and comprises an elongated conduit device which is in separate length portions. A catalytic converter element is interposed between such length portions and fasteners provide for removably securing the length portions together with the catalytic element therebetween.

It is an object of this invention to provide for a method of installing a catalytic booster-type converter into an existing vehicular exhaust system. It is another object of this invention to provide catalytic booster-type apparatus which may be conveniently replaced from time to time to maintain the effectiveness of minimizing atmospheric pollution due to exhaust emissions.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
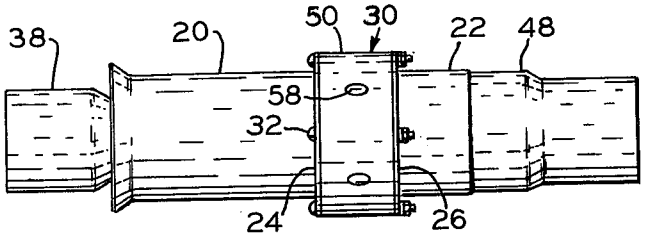
FIG. 1 is a side view of one embodiment of this invention.

Referring to the drawings, and more particularly to FIGS. 1 through 4, the exhaust pipe as mounted on a conventional passenger-type vehicle is indicated by the numeral 10, conventional hangers 12 which are generally U-shaped or in the form of U-bolts, being used to securely mount the pipe 10 on the vehicle frame (not shown). As is shown more clearly in FIG. 3, the exhaust pipe 10 has had a length section intermediate the ends thereof removed thereby providing spaced end portions 14 and 16 which are in longitudinal alignment. A catalytic booster-type converter device as shown in FIG. 1 is adapted to be fitted to the end portions 14 and 16, respectively, of the exhaust pipe 10 so as to constitute a continuation of the exhaust pipe through which the exhaust gases may flow.

Figure 2:
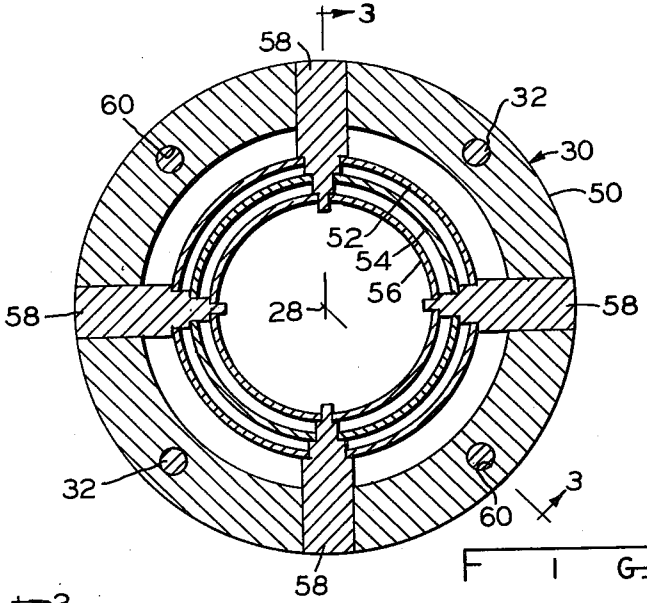
FIG. 2 is a cross section taken substantially along section line 2—2 of FIG. 3.
Figure 3:
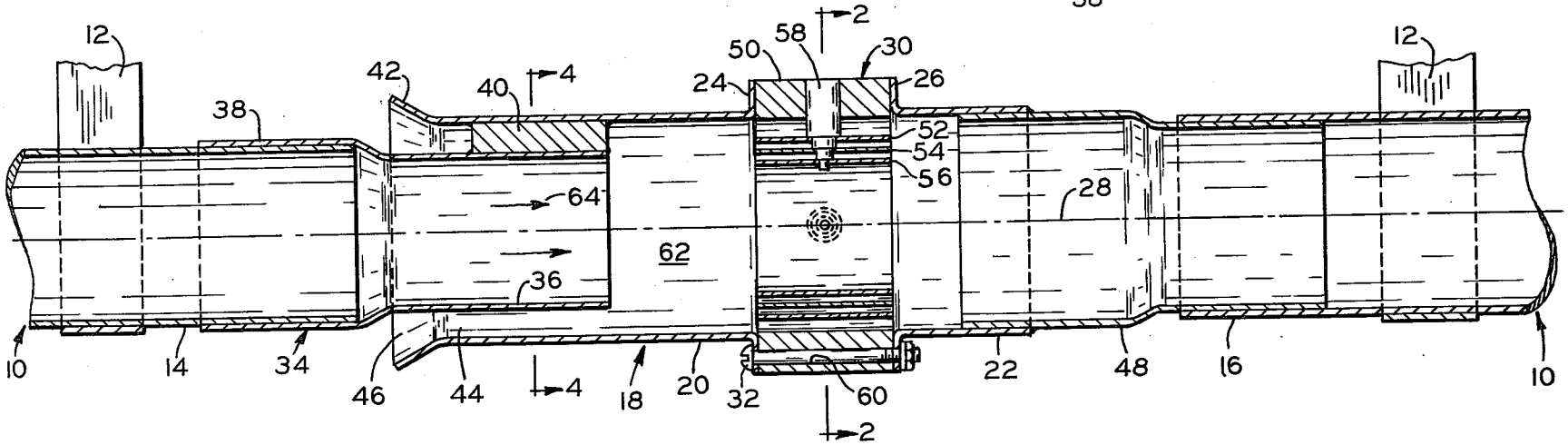
FIG. 3 is a longitudinal sectional view taken substantially along section line 3—3 of FIG. 2.
Figure 4:
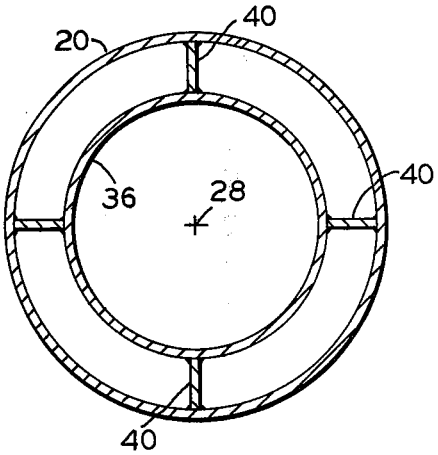
FIG. 4 is a cross section taken substantially along section line 4—4 of FIG. 3.

The converter device of FIG. 1 and as shown in various detail in FIGS. 2, 3 and 4, includes a section of conduit indicated generally by the reference numeral 18 which is divided into two separate length sections 20 and 22, these sections being tubular and preferably of equal diameter. Additionally, these sections are formed to a larger diameter than that of the exhaust pipe 10 to which they are connected.

The adjacent ends of the two length sections 20 and 22 are spaced apart and provided with radially outwardly extending flanges 24 and 26 which lie in planes normal to the axis 28 of the exhaust pipe 10 and conduit section 18. Removably secured between the flanges 24 and 26 is a catalytic converter element indicated generally by the numeral 30, threaded fasteners 32 being used for this purpose.

Secured to the length section 20 is a tubular adaptor generally indicated by the numeral 34 having a reduced diameter portion 36 coaxially positioned in radially spaced relation within the end portion of the section 20 and an enlarged diameter section 38 extending axially therebeyond, this extension 38 having an external diameter which provides a slidably, telescoping fit with the end of the exhaust pipe portion 14. This adaptor 34 is rigidly secured to the conduit section 20 by means of four radial struts or webs 40 as by welding. The distal end of the conduit section 20 is flared outwardly to a funnel shape as indicated by the numeral 42. Thus, the reduced diameter end portion 36 of the adaptor 34 forms with the interior of the conduit section 20 an annular passage 44, the tapered flare 42 defining an air inlet 46 having a cross sectional area larger than that of the annular passage 44. The adaptor 34 in combination with the section 20 thus forms an aspirator with the inlet 46 facing forwardly of the vehicle.

Another tubular adaptor 48 is telescoped into and welded to the distal end portion of the conduit length section 22 as shown, the opposite end portion of the adaptor 48 being reduced in diameter to slidably telescopically fit into the exhaust pipe portion 16 as shown. The adaptors 34 and 48 may be additionally secured to the respective pipe ends 14 and 16 by means of threaded fasteners or clamping bands.

The catalytic element 30 comprises a tubular outer casing 50 along with a plurality of tubing sections 52, 54 and 56 which are coaxially disposed radially inwardly thereof in radially spaced relation. Radially extending pins 58 circumferentially spaced as shown are suitably secured, such as by pressfitting, to the tubular casing 50 and have stepped diameter portions on the inner ends which fit into companion openings in the respective tubing sections 52, 54 and 56. The fit between the tubing sections and the pins 58 may be of close sliding tolerance or press fits as preferred. Thus, the sections 52, 54, 56 are securely positioned in assembly with the tubular casing 50. The lengths of these tubular parts 50, 52, 54 and 56 are made equal and the parts otherwise have their ends in coplanar flush relationship as shown so as to form an assembled component of cylindrical shape having planar ends that are normal to the axis 28.

The tubular casing 50 is provided with a series of axially extending apertures 60 adapted to receive the shanks of the threaded fasteners 32 therethrough, such threaded fasteners 32 having heads on one end and nuts on the other as shown and passing through flanges 24 and 26.

The tubing sections 52, 54 and 56 either constitute or carry the catalytic chemical with which portions of the exhaust gases react for the purpose of removing harmful emissions. Such catalytic agents are conventional, but in this invention, low temperature catalysts ae preferred. Typical of such low temperature catalysts are carbon, charcoal and the like. The tubing sections 52, 54 and 56 may be made of metal, such as steel, which is coated or plated with the catalytic constituent. A low temperature catalyst is preferred, since it is contemplated that the booster device of this invention will be disposed in the exhaust pipe of the vehicle relatively far down stream from the vehicle engine. Conventionally, catalytic converters employ high temperature catalysts that require relatively high temperature exhaust gases for the purpose of producing the necessary catalytic action. Thus, such converters are disposed as closely as possible to the engine so as to receive the hot gases from the engine before they have had a chance to cool down. In the present invention, it is contemplated that such gases will cool down, since the booster element is situated relatively far from the engine.

The booster of this invention may be installed in an existing vehicular exhaust system by first cutting a length out of the exhaust pipe 10 intermediate the ends thereof. This provides spaced exhaust pipe portions such as those indicated by the numerals 14 and 16. It should be noted that the hangers 12 rigidly hold these pipe sections in place relative to the vehicle frame. At this point, one method comprehends the loosening of the hangers 12 and the assembly of the booster device as shown in FIG. 1 to the end portions 14 and 16 of the pipe by merely telescoping the adaptor end 38 over the end portion 14 and the other adaptor 48 into the end portion 16. Since the hangers 12 are loosened, this permits the end portions 14 and 16 to be moved somewhat to accomodate the telescoping fits. Once the booster device is thus assembled, the hangers 12 are tightened thereby rigidly securing not only the end portions 14 and 16 to the car frame but also the booster device itself.

In operation, exhaust gases flow through the exhaust pipe 10 as before and also through the booster device via the adaptor 34, into a chamber region 62 between the adaptor and the catalytic element 30, through the catalytic element 30, the adaptor 48 and out of the aft end portion 16 of the exhaust pipe 10. The converter element 30 is adapted to catalytically oxidize or otherwise remove pollutants in the engine exhaust.

Preferred conversion reactions involve providing air or other oxygen-containing gas, in the eshaust gases prior to contact with the catalyst. This is provided by means of the aspirator 36, 42, 44 and 46 through which ambient air is drawn by reason of the flow of exhaust gases from the engine through the reduced diameter portion 36 of the adaptor 34 in the direction of the arrows 64. The aspirating effect also serves in reducing the pressure at the engine thereby contributing to its efficiency of operation.

After a period of usage, it may be desirable to replace the converter element 30 with another just like it. This is simply accomplished by merely removing the threaded fasteners 32, dropping out the element 30 and then replacing it with another like element secured in place by means of the same fasteners 32. This removal and replacement is accomplished by merely moving the element 30 laterally with respect to the conduit device 18, or in other words, in a direction at right angles to the axis 28 of the exhaust pipe system. Such removal and replacement can be accomplished expeditiously and at minimum cost.

Figure 5:
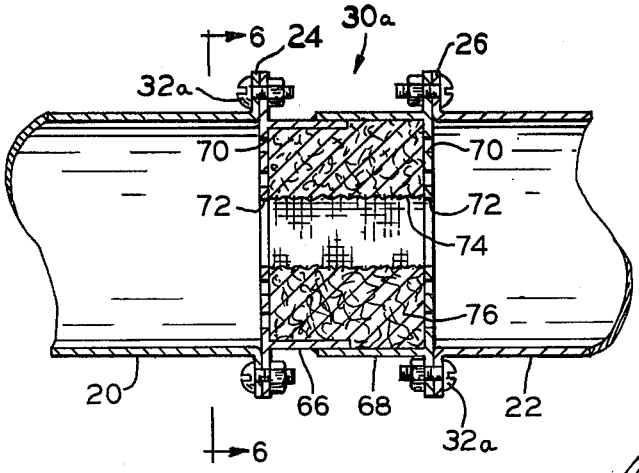
FIG. 5 is a fragmentary, longitudinal sectional view of another embodiment of this invention.
Figure 6:
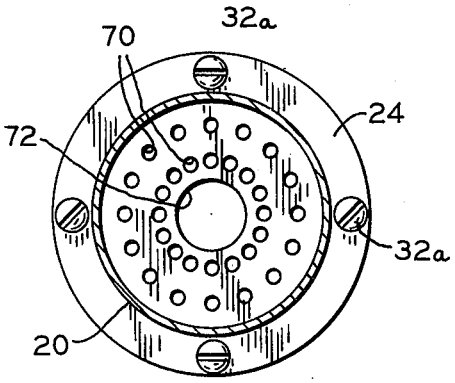
FIG. 6 is a cross section taken substantially along section line 6—6 of FIG. 5.

A slightly different embodiment of the catalytic element is illustrated in FIGS. 5 and 6 wherein the element **30*a* has the same axial dimension and a circumference also the same at least to the extent of being adapted to be secured to the flanges 24 and 26 of the conduit sections 20 and 22. This element 30*a* is composed of two tubular sections 66 and 68 which are telescoped together and secured, such as by welding, thereby providing an open interior. Each of the tubular sections 66 and 68 is provided with cover-like, flat plates on the opposite ends which are provided with a multiplicity of apertures 70 and a relatively large central opening 72. A tubular element 74 of wire mesh screen or the like fits between the cover plates of the two tubular sections 66 and 68 as shown in axial alignment with openings 72 and provides an annular space within which suitable catalytic material 76 is retained. This catalytic material 76 may be in the form of metal wool suitably treated with a chemical catalyst or alternatively any other conventional catalytic material as may be desired. The cover plates extend radially outwardly to provide flanges for securement to the flanges 24 and 26 by means of the threaded fasteners 32***a*.

This element 30*a* can be removed and replaced the same as previously explained.

Figure 7:
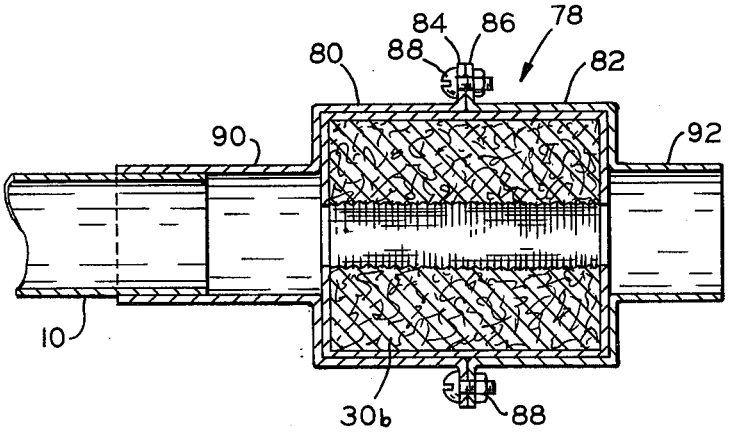
FIG. 7 is a fragmentary longitudinal sectional view of yet another embodiment of this invention.

Yet another embodiment of this invention is shown in FIG. 7 which is so constructed as not to require the removal of a length portion of the existing exhaust pipe. In this embodiment, a cylindrical housing indicated generally by the numeral 78 is made to a diameter larger than that of the exhaust pipe 10 and in two parts denoted by the numerals 80 and 82. These parts 80 and 82 have radially outwardly extending flanges 84 and 86, respectively, which are secured together by means of threaded fasteners 88. The opposite ends of the casing parts 80 and 82 are reduced in diameter to provide tubular extensions 90 and 92, the extension 90 being adapted to be telescoped over and otherwise secured to the end portion of the exhaust pipe 10. A catalytic element 30*b* which may be formed like either of the elements 30 or 30*a* is disposed within the housing 78 as shown and is so sized as to be secured against either radial or endwise movement therein.

The catalytic elements 30, 30*a* and 30*b* may be of different design and employ different catalytic materials than those described; however, it is important that the element retain its cartridge form so that it may be removed and replaced with ease. By making the conduit device that secures the cartridge in place larger in diameter than that of the exhaust pipe, and also by providing an aspirator, the conduit device itself, indicated by the numeral 18 in FIG. 3, becomes a mixing chamber for exhaust gases and ambient air within which a degree of turbulence occurs as well as swirling of the gaseous mixture which ensures circulation of the gases through the catalytic medium within the replaceable cartridge. This tends to ensure catalytic conversion and the reduction of harmful emissions that otherwise would be exhausted into the atmosphere.

While there have been described above the principles of this invention in connection with specific apparatus, it is to be clearly understood that this description is made only by way of example and not as a limitation to the scope of the invention.

What is claimed is:

1. A catalytic booster-type converter for insertion into the exhaust pipe of a vehicular exhaust system comprising an elongated conduit device, said conduit device being in separate length portions, a catalytic converter element interposed between said length portions, and means for removably securing said length portions together with said element therebetween, said means including said converter element being secured between adjacent ends of said length portions and removable therefrom in a direction transverse to the longitudinal axis of said conduit device, said length portions being spaced apart with the adjacent ends juxtaposed, said means including said catalytic element and threaded fasteners securing said element to said ends, said ends having outwardly extending flanges, respectively, said length portions being cylindrical and said element being cylindrical and of a diameter substantially coextensive of that of said flanges, said threaded fasteners passing through said flanges and said element to secure them rigidly together, said element including a rigid tubular outer portion through which said threaded fasteners pass, a plurality of tubular catalytic elements coaxially disposed within said tubular outer portion in radially spaced relation, circumferentially spaced radially inwardly extending pin elements, each of said pin elements having contiguous portions of successively decreasing diameter in a radially inward direction and defining shoulders therebetween, said coaxially disposed catalytic elements being radially and longitudinally supported by said shoulders and said contiguous portions, respectively, the lengths of said tubular elements being no longer than that of and being disposed in said tubular portion whereby the spacing between said flanges is coextensive with the length of said tubular portion whereby said catalytic converter element can be replaced by movement thereof laterally with respect to said conduit device.

* * * * *